US007377725B2

(12) United States Patent
Cammack

(10) Patent No.: US 7,377,725 B2
(45) Date of Patent: May 27, 2008

(54) ARCHED SOIL NAIL WALL

(76) Inventor: Charles H. Cammack, 7911 Darnell, Lenexa, KS (US) 66215

( * ) Notice: Subject to any disclaimer, the term of this patent is extended or adjusted under 35 U.S.C. 154(b) by 157 days.

(21) Appl. No.: 11/325,641

(22) Filed: Jan. 4, 2006

(65) Prior Publication Data

US 2006/0153646 A1 Jul. 13, 2006

Related U.S. Application Data

(60) Provisional application No. 60/643,253, filed on Jan. 12, 2005.

(51) Int. Cl.

| | |
|---|---|
| ***E02D 17/20*** | (2006.01) |
| ***E02D 5/80*** | (2006.01) |
| ***B21F 27/08*** | (2006.01) |
| ***E04H 17/04*** | (2006.01) |

(52) U.S. Cl. ..... 405/284; 405/262; 405/272; 405/302.7; 256/35

(58) Field of Classification Search ..... 405/262, 405/272, 284, 285, 302.2, 302.4–302.7; 256/24, 256/29, 30, 31, 32, 35, 36, 45
See application file for complete search history.

(56) References Cited

U.S. PATENT DOCUMENTS

| | | | | |
|---|---|---|---|---|
| 2,880,588 | A * | 4/1959 | Moore | 405/285 |
| 4,106,225 | A | 8/1978 | Schnabel, Jr. | |
| 4,124,983 | A * | 11/1978 | Weatherby | 405/259.5 |
| 4,369,004 | A | 1/1983 | Weatherby | |
| 4,480,945 | A | 11/1984 | Schnabel, Jr. | |
| 4,505,621 | A * | 3/1985 | Hilfiker et al. | 405/284 |
| 4,561,804 | A | 12/1985 | Weatherby | |
| 4,718,791 | A | 1/1988 | Weatherby | |
| 4,728,225 | A * | 3/1988 | Brandl et al. | 405/262 |
| 4,798,499 | A * | 1/1989 | Yamada | 405/286 |
| 4,836,718 | A * | 6/1989 | Deaton | 405/262 |
| 4,911,582 | A * | 3/1990 | Peirce et al. | 405/262 |
| 4,911,583 | A * | 3/1990 | Carey | 405/262 |
| 4,913,594 | A * | 4/1990 | Sigourney | 405/285 |
| 4,952,097 | A * | 8/1990 | Kulchin | 405/262 |
| 5,002,436 | A | 3/1991 | Sigourney | |
| 5,174,688 | A * | 12/1992 | Meheen | 405/284 |
| 5,195,849 | A * | 3/1993 | Stapleton | 405/282 |
| 5,395,185 | A | 3/1995 | Schnabel, Jr. | |
| 5,456,554 | A * | 10/1995 | Barrett et al. | 405/284 |
| 5,551,810 | A | 9/1996 | Franceski et al. | |
| 5,588,784 | A | 12/1996 | Brandl et al. | |
| 5,788,411 | A | 8/1998 | Campbell | |
| 5,957,627 | A * | 9/1999 | Stankus et al. | 405/288 |
| 6,299,386 | B1 * | 10/2001 | Byrne et al. | 405/273 |
| 6,857,823 | B1 * | 2/2005 | Hilfiker et al. | 405/262 |
| 6,874,975 | B2 * | 4/2005 | Hilfiker et al. | 405/262 |
| 2005/0008438 | A1 * | 1/2005 | Babcock | 405/259.1 |

OTHER PUBLICATIONS

Richard L. Handy, *The Arch in Soil Arching*, Journal of Geotechnical Engineering, vol. 111, No. 3, Mar. 1985, at 302.

* cited by examiner

*Primary Examiner*—Tara L. Mayo
(74) *Attorney, Agent, or Firm*—Hovey Williams LLP

(57) ABSTRACT

Three-dimensional soil nail walls employing geosynthetic materials and methods of installation thereof. The soil nail walls are suitable for supporting an upright face of earth and comprise tensioned geosynthetic material held up against the face.

29 Claims, 15 Drawing Sheets

ARCHED SOIL NAIL WALL

RELATED APPLICATION

This application claims the priority benefit of U.S. Provisional Patent Application Ser. No. 60/643,253, filed Jan. 12, 2005, which is incorporated by reference herein.

BACKGROUND OF THE INVENTION

1. Field of the Invention

The present invention relates generally to the construction of three-dimensional soil nail walls comprising geosynthetic material facing systems, and optionally steel wire rope wales and soldier piles. A three-dimensional face wall including alternating, vertically-extending recessed and protruding portions is excavated that has a serpentine, ribbon-like arrangement. The geosynthetic materials are connected to the soil nails and then tensioned and drawn toward the slope so as to apply pressure to the soil face thereby creating zones of compressed soil within the slope.

2. Description of the Prior Art

Retaining wall systems are essential components of many excavation projects. Conventional soil nail (CSN) walls are commonly used in this capacity. CSN walls comprise a plurality of soil nails installed in a generally planar upright face of soil. Small diameter steel reinforcing bars and welded wire mesh are held up against the upright face, and a layer of shotcrete is applied over the top of the wire mesh and reinforcing bars.

CSN walls are typically constructed by first excavating a 3-5 feet high, self-supporting vertical slope along the wall alignment. Soil nails are then installed at points about two feet above the base of the excavation at 5-8 feet intervals. Soil nails are referred to as "passive inclusions" as tensile stress only develops within the steel threadbars of the soil nails after ground movement occurs. Next, drainage strips comprising rectangular plastic tubes surrounded by geotextile fabric are placed against the exposed soil face. These drainage strips generally extend from near the top of the slope all the way to the bottom and must be manipulated during each stage of the construction process.

Steel reinforcing bars are then attached to the threadbars protruding from the soil nails and serve as horizontal and vertical wales. Welded wire mesh is then attached to the soil nails and to the wales. During this process, the cement grout used to construct the soil nails cures and gains strength. Shotcrete is applied to the exposed slope covering the welded wire mesh and reinforcing bars. The shotcrete is allowed to cure over a period of 1-3 days. During this time, also known as the required stand up time, the slope must be self-supporting. The process is repeated until the entire slope is excavated and supported.

Shotcrete facing systems present numerous problems which make them unsuitable for installation under certain conditions. Steel-reinforced shotcrete soil nail wall facings are difficult to install in cold weather. The air used to propel the shotcrete onto the slope expands at the applicator nozzle and may cause the shotcrete to freeze if the ambient air temperature is below about 40° F. In addition, ground water can collect between the soil face and the shotcrete and lead to fracturing of the shotcrete around the soil nail heads.

Shotcrete also provides a very crude finish thereby making the CSN wall unaesthetic. Highly trained "shotcrete artisans" can be hired to create visually enhanced surfaces that resemble, for example, limestone blocks. However, the labor and materials required to provide such finishes are expensive. Thus, numerous methods have been devised to attach fascia walls on the outside of the shotcrete in order to reduce concerns over cracking of the shotcrete and to provide a more pleasing exterior finish.

Prior to assembly of the fascia wall, a second coating of reinforced shotcrete equipped with numerous anchors must be constructed to provide sufficient strength to support the fascia wall. This method of supporting the fascia wall is not desirable in that it is indirectly supported in the primary wall structure, increases the cost of wall construction, and provides another mechanism that could lead to wall failure.

CSN walls rely upon soil nails rather than foundations for vertical support. Thus, CSN wall facings are free to slump downward throughout their height as soil conditions change and may result in the wall top moving toward the excavation. The wall's appearance may remain marred even after repairs are performed.

Perhaps the greatest shortcoming of CSN walls is that they do not actively impose any pressure against the vertical slope. Face pressures only develop passively as ground movements occur. Reinforced shotcrete facings must bend to restrain soil from moving further, but in actuality, these facings present little bending strength and tend to readily crack. In many applications, only one layer of reinforcing steel is provided. As tension develops in the reinforcing steel, the shotcrete facing bulges outward resulting in the formation of cracks.

Soil arching is a phenomenon that increases the integrity of soil formations. It has been discovered that soil arching occurs within horizontal trenches when the trench sidewalls support a portion of the weight of the backfill through friction forces. The soil presses outward against the walls of the trench thereby inducing friction that partially supports the backfill and reduces loads placed on buried pipes. Purely analytical theories have been proposed to explain this condition based on elastic theory and basic soil properties. It has been discovered also that piles or piers separated by small gaps are capable of supporting vertical slopes. Exposed soil in the gaps between piers tends to fall away until a stable, concave surface develops behind the piers. This feature, indicative of soil arching, shows that zones of compressed soil develop behind the piers.

Another, more modern type of retaining wall is a wrapped-face mechanically stabilized earth (MSE) wall. Wrapped-face MSE walls employ strips of geosynthetic material which are horizontally laid. Backfill material is laid on top of the geosynthetic material strips, and the strips are wrapped around the face of the backfill forming a wall layer. Addition layers are constructed until the wall has attained the desired height. Tensile stresses develop passively in the geosynthetic material used in wrapped-face MSE retaining walls as ground movements occur.

Steep vertical slopes, such as those located on the west coast of the United States, can become unstable and collapse following periods of heavy rain. Seepage forces due to groundwater that flows through the soil and down to lower elevations can lead to a loss of slope strength. CSN walls are largely ineffective in these areas because they are not aesthetically pleasing. The passive support offered by CSN walls does not address the larger problem of preventing ground movement.

Thus, a real and unfulfilled need exists for an active retaining wall system that takes advantage of the soil arching phenomenon and does not possess the above-described problems which are inherent of conventional passive systems. There is also a need for an inexpensive wall which can be constructed in soil formations exhibiting shorter standup times than is acceptable with CSN wall construction.

OBJECTS AND SUMMARY OF THE INVENTION

It is, therefore, an object of the present invention to provide a three-dimensional soil nail wall that is inexpensive to construct, requires a short standup time, and minimized ground movement.

It is another object of the present invention to reduce the time required for construction of soil nail walls by eliminating the time required for assembly of a steel reinforcing system and curing of shotcrete.

It is yet another object of the present invention to allow construction of soil nail walls during cold weather, to reduce problems related to ice formation, and to eliminate shotcrete cracking problems.

It is still another object of the present invention to provide drainage through the entire face area of the excavation thereby eliminating the need to install special drainage products.

It is a further object of the present invention to develop soil arching conditions before significant excavation commences so as to reduce ground movements and increase the standup time of the soil.

It is another object of the present invention to provide a less costly method of adding fascia walls in front of soil nail walls thereby making them permanent installations.

It is still another object of the present invention to provide a tiered wall system that reinforces existing, near vertical slopes while providing a suitable environment for plant growth capable of covering the wall.

It should be understood that the above-listed objects are only exemplary, and not all the objects listed above need be accomplished by the invention described and claimed herein.

Accordingly, in one embodiment of the present invention, a system for maintaining the integrity of an upright face of earth is provided comprising: a plurality of spaced-apart soil nails extending into the earth; and a tensioned web of pliable material held against the upright face by said soil nails, said web creating at least one zone of compressed soil behind the upright face.

In another embodiment of the present invention, a system for maintaining the integrity of an upright face of earth is provided comprising: a plurality of spaced-apart piles extending vertically into the earth, the upright face presenting a plurality of vertically-extending recessed portions formed between adjacent piles; a plurality of spaced-apart soil nails inserted into the upright face within the recessed portions; at least one reinforcing cable stretched across the upright face and coupled to said soil nails; and a web of pliable material held against the upright face.

In yet another embodiment of the present invention, a tiered wall system is provided comprising: a first tier comprising—first and second vertically-spaced rows of soil anchors; a first web of pliable material extending between the first and second rows of soil anchors and held in tension against a first upright face of earth; and a second tier comprising—the second row of soil anchors and a third row of soil anchors vertically spaced from the second row; a second web of pliable material extending between the second and third rows of soil anchors and held in tension against a second upright face of earth offset from the first upright face of earth.

In still another embodiment of the present invention, a method of maintaining the integrity of an upright face of earth is provided comprising the steps of: (a) excavating a first section of the upright face thereby forming a plurality of vertically-extending recessed portions; (b) installing a first set of spaced-apart soil nails into said recessed portions; (c) extending a first web of pliable material across said first section of the upright face; and (d) coupling said web to said first set of soil nails thereby holding said web in tension against the first section of the upright face.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
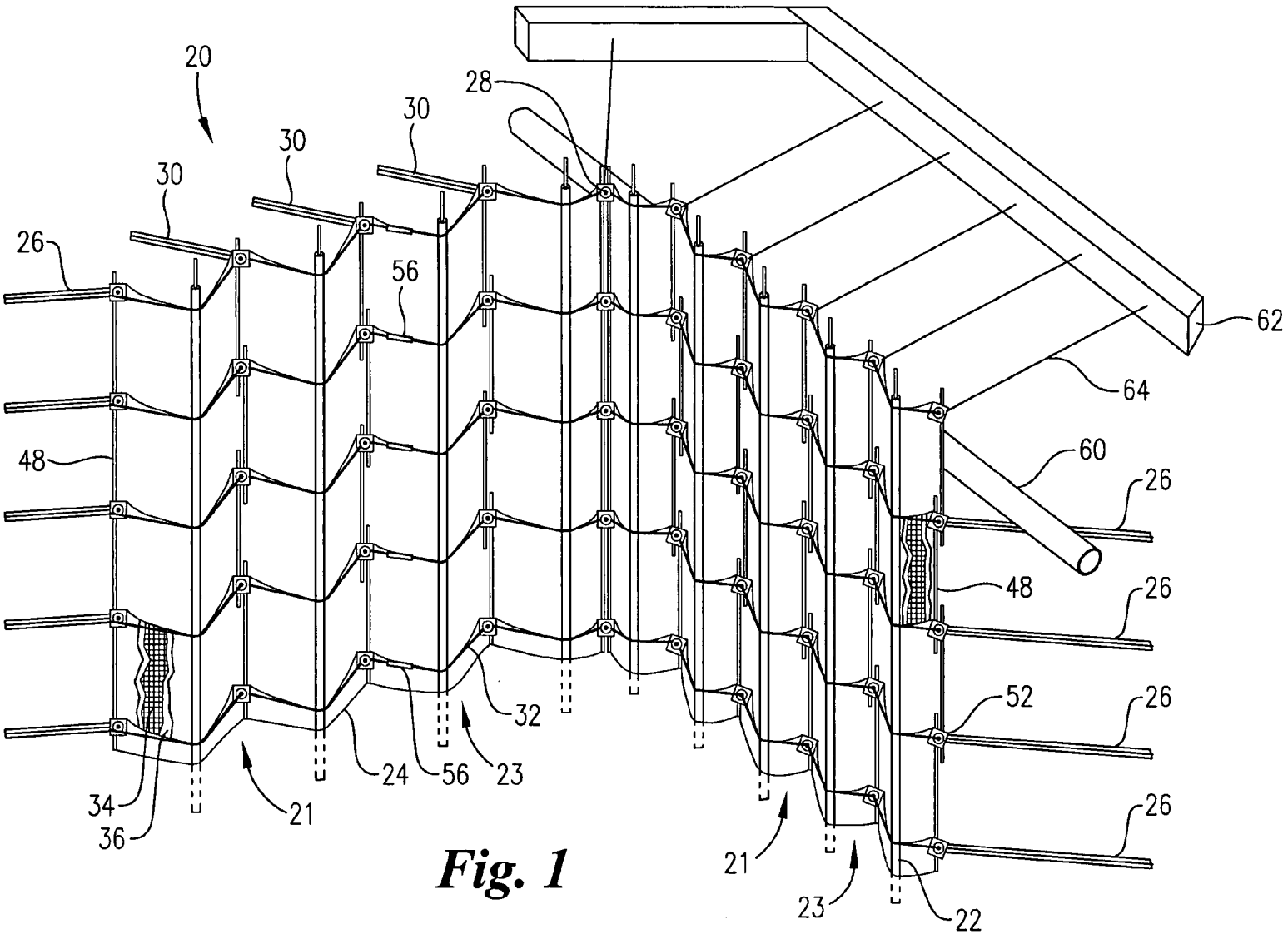
FIG. 1 depicts an isometric view of a three-dimensional soil nail wall with a tensioned geosynthetic facing.

Referring initially to FIG. 1, a soil nail wall system 20 is depicted supporting a rectangular excavation, the inside corner of wall 20 being in the center of the view. An upright face 24 of the excavation presents a number of recessed areas 21 formed therein. Recessed areas 21 cause face 24 to assume an undulating, three-dimensional profile comprising alternating, vertically-extending recesses 21 and protrusions 23.

In this particular embodiment, wall 20 comprises a plurality of vertically-installed piles 22 spaced across upright face 24 of the rectangular excavation. Wall system 20 also includes a plurality of conventional soil nails 26-30 installed in recessed areas 21. A plurality of reinforcing cables 32, also referred to herein as wire rope wales, extend across upright face 24 and are secured to soil nails 26-30. A plurality of sheets of a web 34 comprising a mesh of pliable material (also referred to herein as sheets of geogrid) and a geotextile fabric 36 cover substantially the entire face 24 of the excavation. In this embodiment, web 34 and fabric 36 comprise two separate sheets of material. However, it is within the scope of the present invention for these two sheets to be supplied as a single, 2-ply sheet. Web 34 and fabric 36 are held against upright face 24 by soil nails 26-30 and wales 32.

Preferably, soil nails 26-30 are constructed by drilling a 4-12 inch diameter hole 38 in face 24 of the excavation at a down angle of about 15° from the horizontal. Hole depth typically ranges from about 10-30 feet. A steel threadbar 40 with centralizers is inserted full-length into hole 38 which is then filled with cement grout beginning with the bottom of the hole using a grout pump and grout pipe. Preferably, the cement grout contains fibrillated polyethylene fibers which increase the tensile and shear strength of the grout. The grout is allowed to cure and gain strength. Threadbar 40 preferably extends about 1-2 feet beyond the nail head 42 to permit later application of fasteners to the bar.

Three kinds of soil nails are used in the construction of wall system 20 as shown in FIG. 1: single-anchor soil nails 26, double-anchor soil nails 28, and free-field soil nails 30. Single-anchor soil nails 26 are installed at the ends of soil nail rows and are used as a termination structure for wall 20. Single-anchor soil nails 26 anchor one end of a segment of wire rope 32 and also support the ends of the sheets of web 34 and fabric 36. As explained in further detail below, web 34 is held up against face 24 under tension. As a result, web 34 primarily applies shear (lateral) forces to single-anchor soil nails 26 which are equaled by the passive resistance provided by soil surrounding the soil nails.

Free-field soil nails 30 are installed in face 24 midway between single-anchor soil nails 26 and do not have anchorage members (i.e., wire rope ends) attached thereto. While web 34 is secured to free-field soil nails 30, nails 30 do not support large shear forces, but do support tensile forces.

Double-anchor soil nails 28 are installed at locations chosen to be anchor points for two adjacent intervals of free-field soil nails. Thus, the ends of two sections of wire rope 32 are anchored within double-anchor soil nails 28. Double-anchor soil nails may also anchor the ends of adjacent sections of web 34. Thus, the sections of web 34 apply approximately equal but opposite shear forces to double-anchor soil nails 28.

Figure 2:
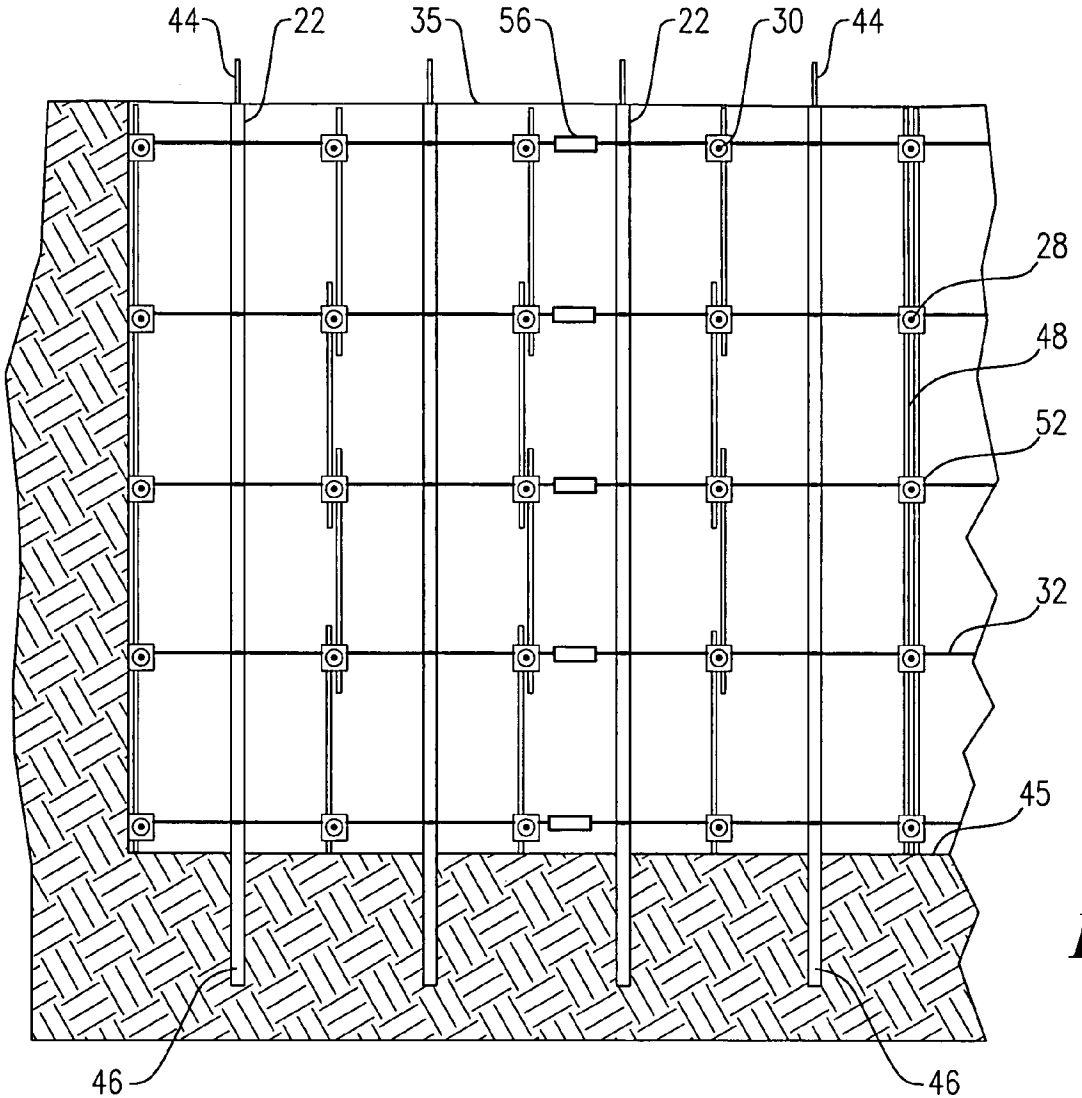
FIG. 2 is an elevation view of a soil nail wall in accordance with the present invention.
Figure 7:
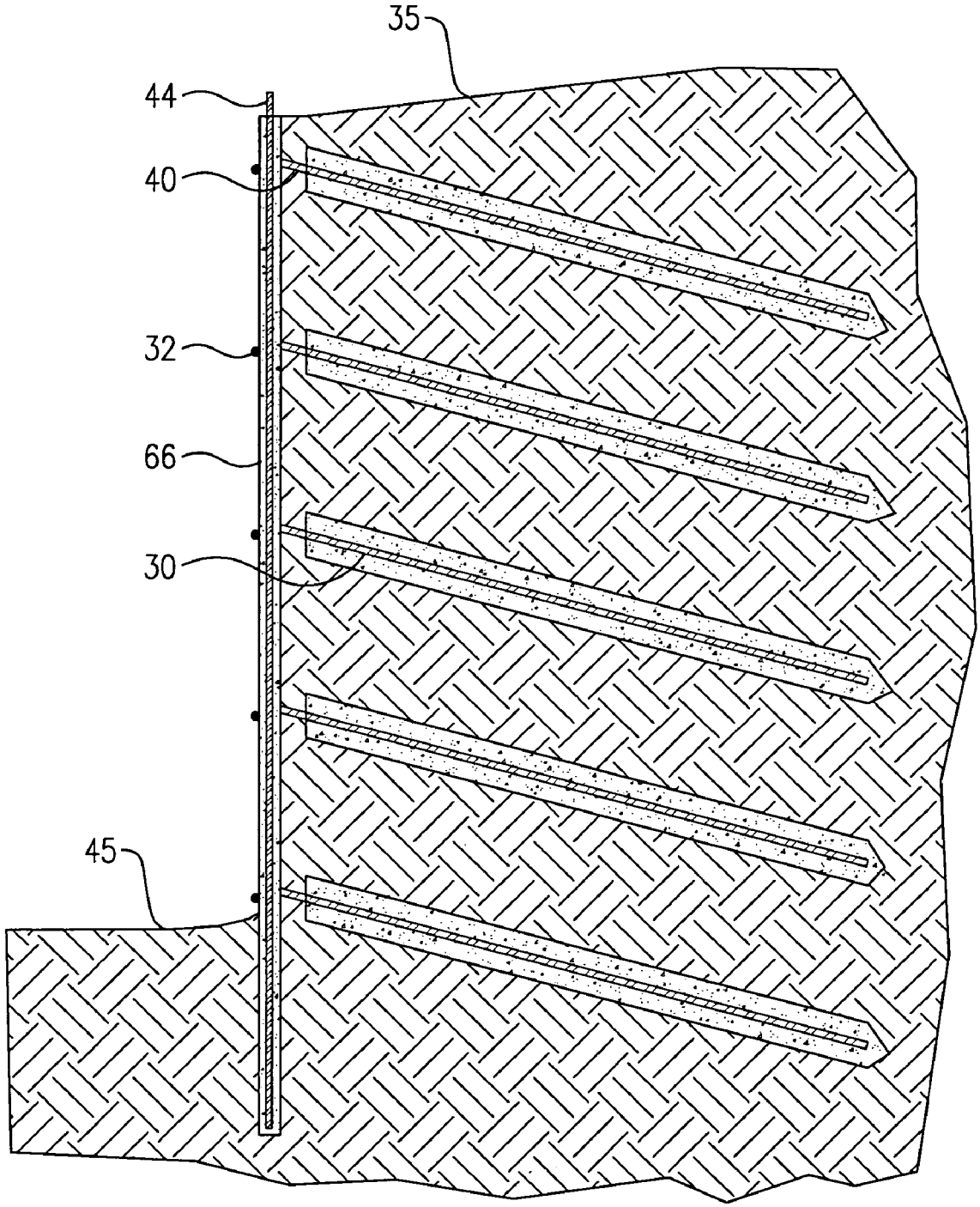
FIG. 7 is a vertical cross-sectional view of a soil nail wall made in accordance with the present invention.
Figure 8:
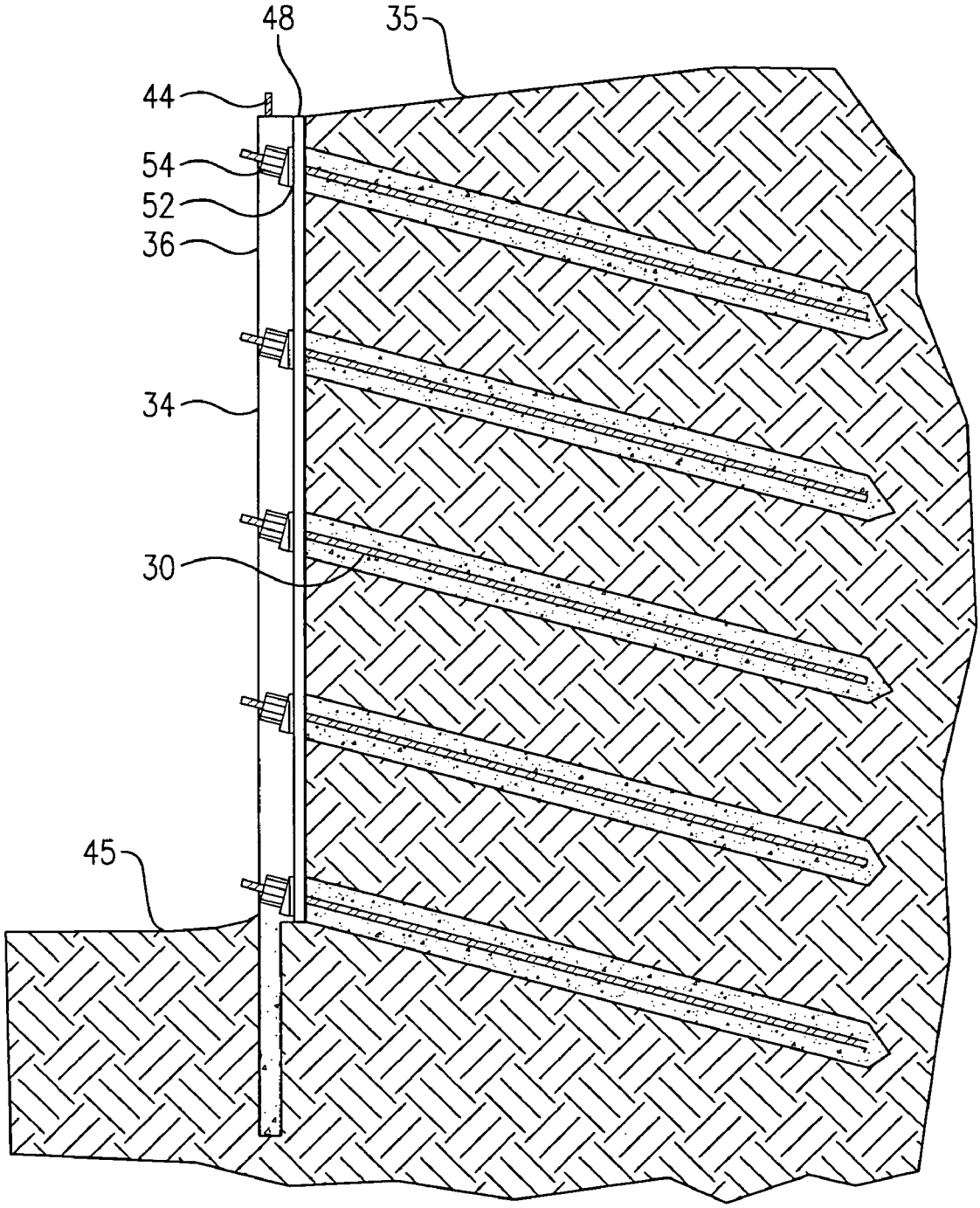
FIG. 8 is a vertical cross-sectional view of the soil nail wall of FIG. 7 taken through a column of soil nails.

Piles 22, also referred to herein as soldier piles, are preferably vertically-installed soil nails which extend from the top 35 to the bottom 45 of the excavation. (See, FIGS. 2, 7, and 8). Piles 22 are generally installed before any excavation takes place and, as shown in FIG. 2, preferably extend a sufficient distance below the lowest planned excavation level 45 to develop vertical support for wall system 20. As with the construction of soil nails 26-30 above, steel threadbars 44 equipped with centralizers are placed in vertically-drilled holes 46 which are then filled with grout. During excavation, recessed areas 21 are formed between adjacent piles 22.

Figure 4:
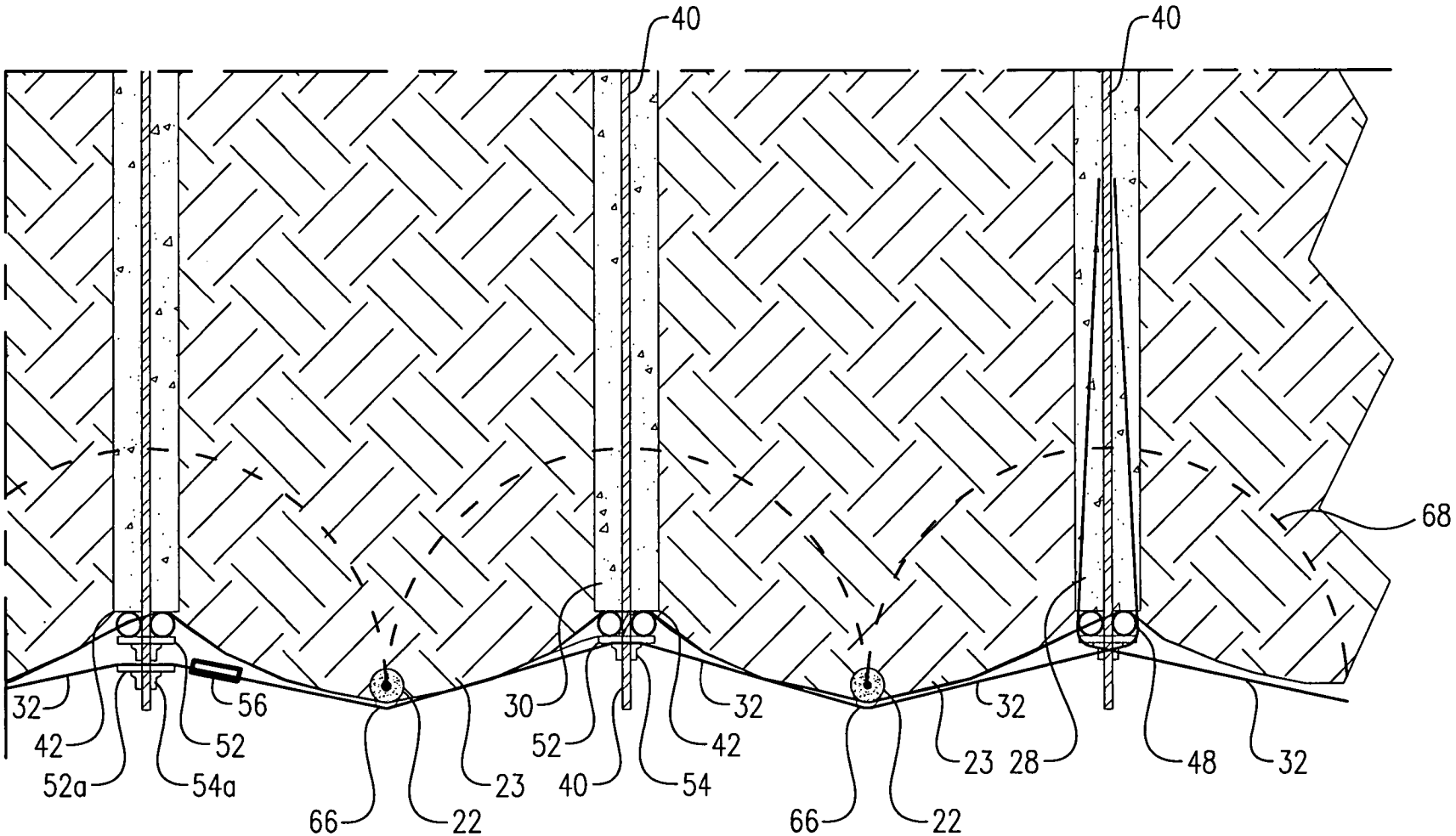
FIG. 4 is a detailed view of the soil nail wall of FIG. 3.
Figure 5:
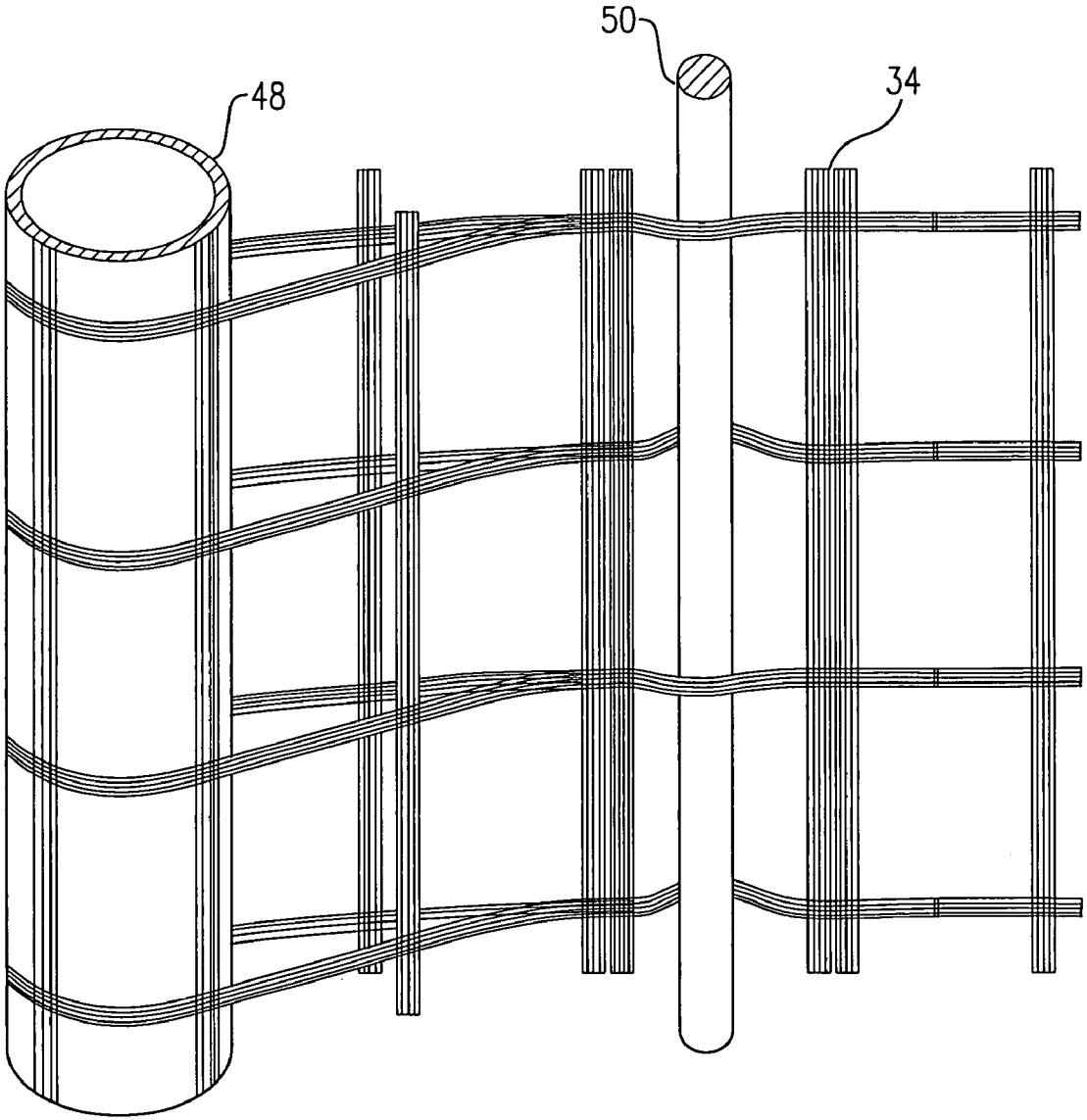
FIG. 5 depicts a method of securing the pliable web material for use in a soil nail wall.

FIGS. 4 and 5 depict a preferred method for securing web 34 to soil nails 26-30. The end of a section of web 34 is wrapped around a structural member 48, which is, in this embodiment, a section of pipe. Web 34 is secured to itself using a rod 50 that is threaded or woven through the mesh material. Structural members 48 are placed within recessed areas 21 and secured against nail heads 42 by plates 52 and nuts 54 which are threaded onto threadbars 40. When securing web 34 to free-field soil nails 30, structural members 48 are placed on the outboard side of web 34 and secured by plates 52 and nuts 54. These members 48 generally overlap the next vertically-adjacent member. Members 48 secured to double-anchor soil nails 28 and single-anchor soil nails 26 are joined end-to-end. When structural members 48 are fully secured, web 34 is pressed against upright face 24 and exerts a force thereon.

Figure 6:
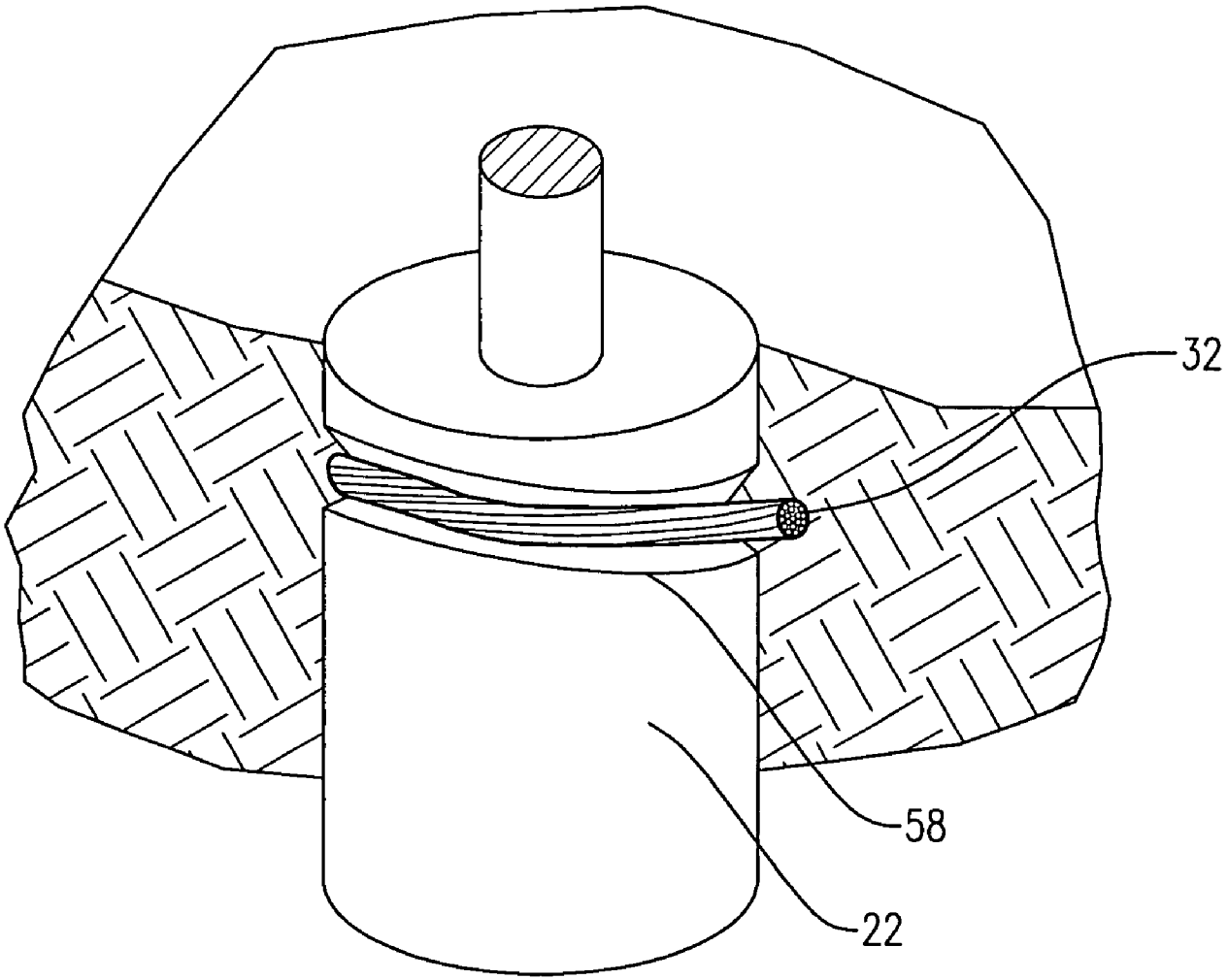
FIG. 6 shows a wire rope wale supported by a notch in a vertically-installed pile.

Wire rope 32 is also secured to soil nails 26-30 by plates 52 and nuts 54. Sections of wire rope 32 are joined by couplers 56 after being tensioned against each other. Thus, wire ropes 32 form wales which press against and draw piles 22 toward upright face 24. Preferably, there is at least one wale 32 for each horizontal row of soil nails 26-30. As shown in FIG. 6, a notch 58 may be formed in pile 22 which vertically supports wire rope 32 as it passes there-around.

As noted above, web (or geogrid) 34 is preferably a mesh material formed from a pliable synthetic resin material which may be coated with another synthetic resin material. Preferably, web 34 is inert to biodegradation and resistant to natural chemicals present in the soil, such as alkalis and acids. Geogrid materials exhibit relatively high tensile strengths thereby making them suitable for use in exerting a compressive force against upright face 24. Exemplary geogrid materials are available from Strata Systems, Inc., Cumming, Ga.

Preferably, geotextile fabric 36 is positioned between upright face 24 and web 34. The primary function of geotextile fabric 36 is to stabilize the soil particles making up upright face 24 and to allow drainage of any groundwater therefrom. Like the geogrid materials, geotextile fabrics are made from synthetic resin materials, or synthetic resin-coated materials, that are relatively non-biodegradable and resistant to natural chemicals found in the soil.

In certain applications which encroach upon shallow underground utilities 60, a deadman 62 and tiebacks 64 may be used in place of the top row of soil nails 26-30.

Installation of wall system 20 as shown in FIG. 1 begins by inserting soldier piles 22 into the ground, spaced along the vertical plane in which upright face 24 is to be excavated. After the cement grout of the solider piles has gained sufficient strength, a vertical excavation, approximately one to two feet deep, is made along the front face 66 of the soldier piles 22. Vertical groves, approximately 1 foot deep, are then excavated in face 24 midway between adjacent soldier piles 22 thereby forming recessed areas 21.

Conventional soil nails 26-30 are installed at the bottom of the groves at a depth of between about 1-2 feet below the ground surface. One end of wire rope 32 is inserted into either a single-anchor soil nail 26 or a double-anchor soil nail 28, depending upon its location, to anchor the wire rope 32. Another wire rope 32 is similarly anchored into a second soil nail 26, 28 located some distance from the first. The two selected anchor soil nails 26, 28 define an anchorage interval. The lengths of wire ropes 32 are selected so that they overlap slightly when brought together against faces 66 of piles 22. Horizontal notches 58 are cut in the exposed faces 66 at the soil nail level. After the grout in the soil nails has cured, the two sections of wire rope 32 are placed in notches 58, tensioned against each other, and secured with a coupler 56 to form a wire rope wale.

Figure 3:
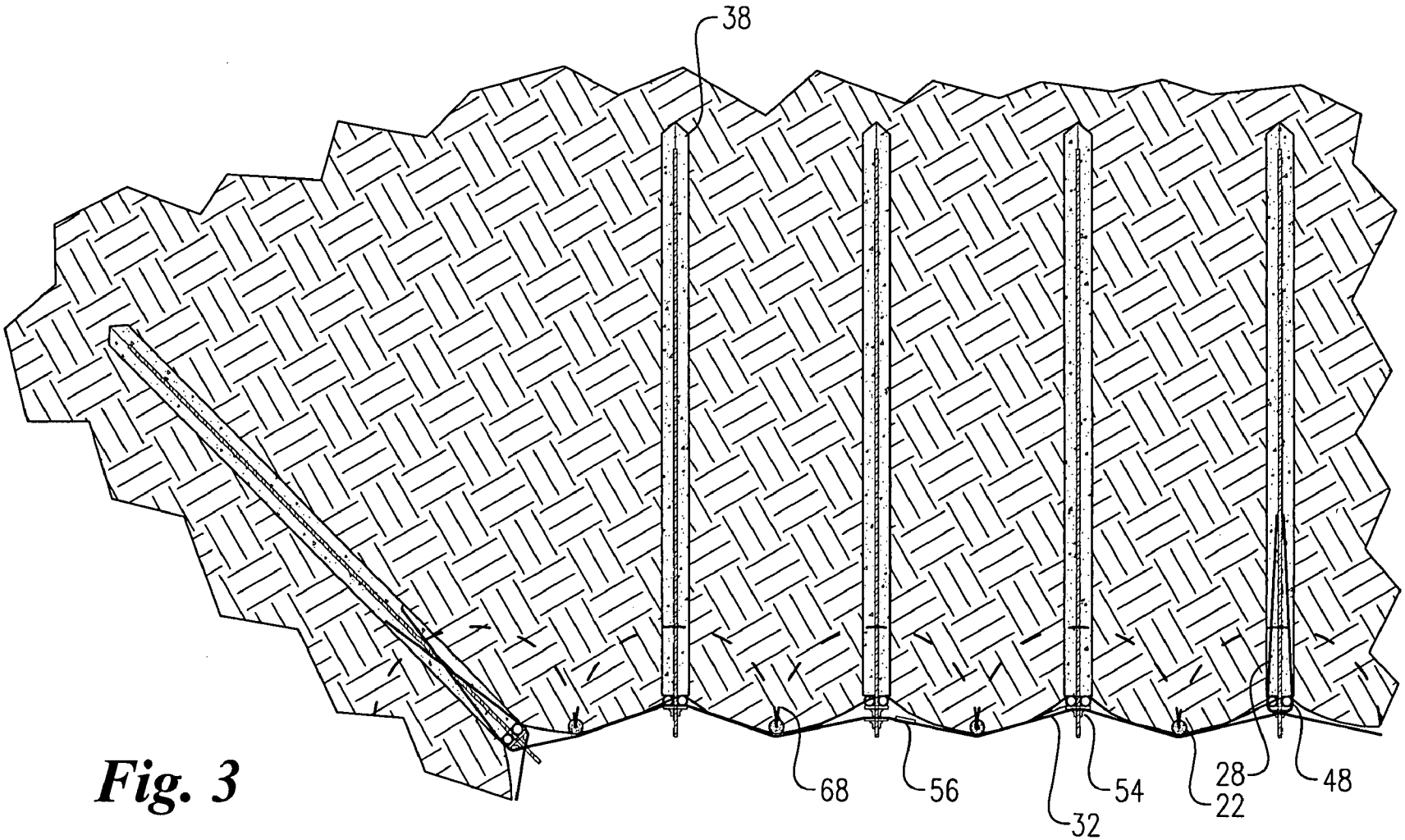
FIG. 3 is a horizontal cross-sectional view of a soil nail wall according to the present invention.

Bearing plates 52 and nuts 54 are attached to the threadbars 40 of each free-field soil nail 30. Turning of nuts 54 causes plates 52 to move toward face 24 and engage wire rope 32. Continued turning of nuts 54 cause wire rope 32 to pull piles 22 toward face 24 thereby creating zones of compressed soil behind face 24. These zones are indicated by stress trajectories 68 shown in FIGS. 3 and 4. The increased compressive stresses within the soil allow the next full stage of excavation to be made with little ground movement and increased soil standup time.

The excavation is extended to a depth of about 3-6 feet below the upper row of soil nails at an angle of about 15° from the vertical. The excavation depth generally corresponds to the width of a strip of web material 34. A second row of soil nails 26-30 is installed near the base of the excavation directly below soil nails 26-30 in the upper row so that the soil nails heads 42 are in substantial vertical alignment. Nail heads 42 of the second row are positioned about at least one foot below the surface of the 15° incline. Lengths of wire rope 32 are anchored in two soil nails 26, 28 of the second row. These two soil nails 26, 28 define an anchorage interval.

After the soil nail grout has cured, additional soil is excavated from within the anchorage interval so that the excavation face 24 is substantially vertical. Horizontal notches 58 are cut in the face 66 of the exposed soldier piles 22 at the level of the second row of soil nails. Further excavation occurs so as to extend recessed areas 21 downward to the level of the second row of soil nails. The free ends of the sections of wire rope 32 anchored in the second row of soil nails are brought together so that they bear against face 66 of the soldier piles 22. Wire rope sections 32 are tensioned against each other and secured with a coupler 56 to form a second horizontal wale. A second plate 52*a* and nut 54*a* may be secured to the soil nail adjacent coupler 54 in order to adjust the tension of the wale following coupling of the wire rope lengths.

A strip of geotextile fabric 36 which is about one foot longer and one foot wider than the anchorage interval is cut and prepared. The geotextile strip 36 is held up against the upright face 24 and secured to the soil nails 26-30 of the first row. A strip of web material 34 that is about one foot longer than the anchorage interval is cut and prepared. The strip of web 34 presents a width which is at least equal to the vertical distance between the first and second row of soil nails. Strips of web 34 can be folded lengthwise where the vertical distance between soil nails varies due to changing ground slope.

Structural members 48, such as galvanized steel pipes, are fastened to the ends of the strips of web 34 as described above. The strips are drawn taut by pulling on structural members 48. Two members 48 are placed on the outboard sides of the soil nails 26, 28 that define the anchorage interval and secured using plates 52 and nuts 54 mounted on threadbars 40. A spacer (not shown) may be provided on the side of the threadbar 40 opposite member 48 to temporarily support plate 52. Additional structural members 48 are inserted into recessed portions 21 corresponding to free-field soil nails 30 in order to securely hold the web in each recessed portion 21 to avoid slackening of the web material 34. Nuts 54 are tightened until the strips of web 34 are tightly held against and exert a compressive force on upright face 24.

The next section of face 24 is ready for excavation. The excavation is extended about 3-6 feet below the second row of soil nails at an angle of about 15° from the vertical, and the process repeats itself until the desired final excavation depth is reached.

Figure 13:
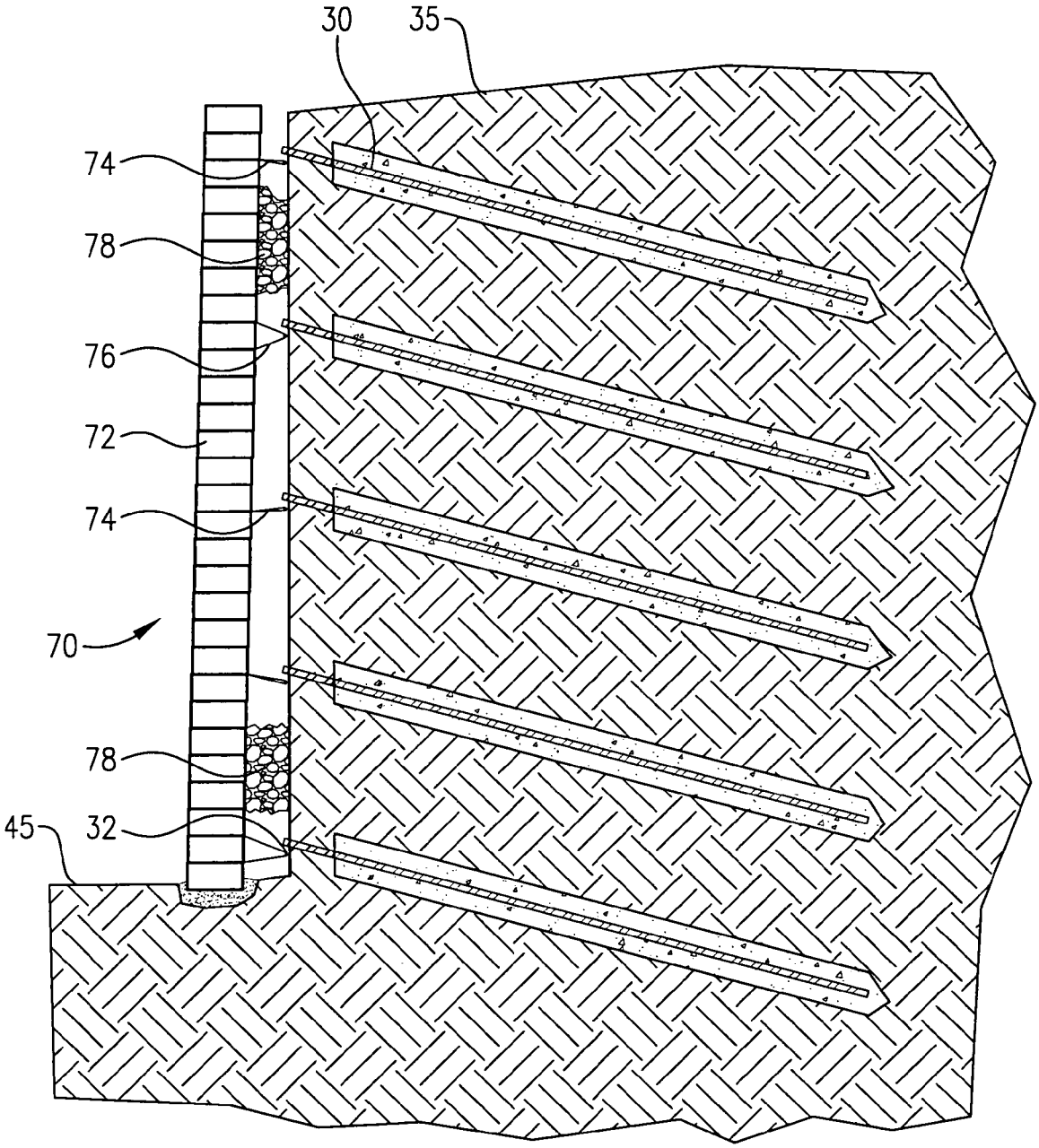
FIG. 13 is a vertical cross-sectional view of a soil nail wall having a fascia wall attached thereto.

Following completion of wall system 20, a decorative fascia wall 70 may be constructed as shown in FIG. 13. Preferably, fascia wall 70 comprises modular concrete blocks 72, however, any suitable material known to those of skill in the art may be used. Short strips of geogrid material 74, 76 are employed to secure wall 70 to wall system 20. More specifically, geogrid strips 74 are placed between concrete blocks 72 near the level of the wales formed by the sections of wire rope 32. Strips 74 extend back toward upright face 24 and wrap around the wire rope wales. Strips 74 are then secured to the wale by inserting pins through the geogrid in a manner similar to that shown in FIG. 5. Alternatively, geogrid strips 76 may wrap around wale 32 and extend back to the concrete blocks 72 where they are secured by inserting pins through the geogrid material. Crushed rock 78 is placed between wall system 20 and fascia wall 70 as the fascia wall is constructed. Additional rows of blocks 72 and backfill are added to complete fascia wall 70.

Figure 9:
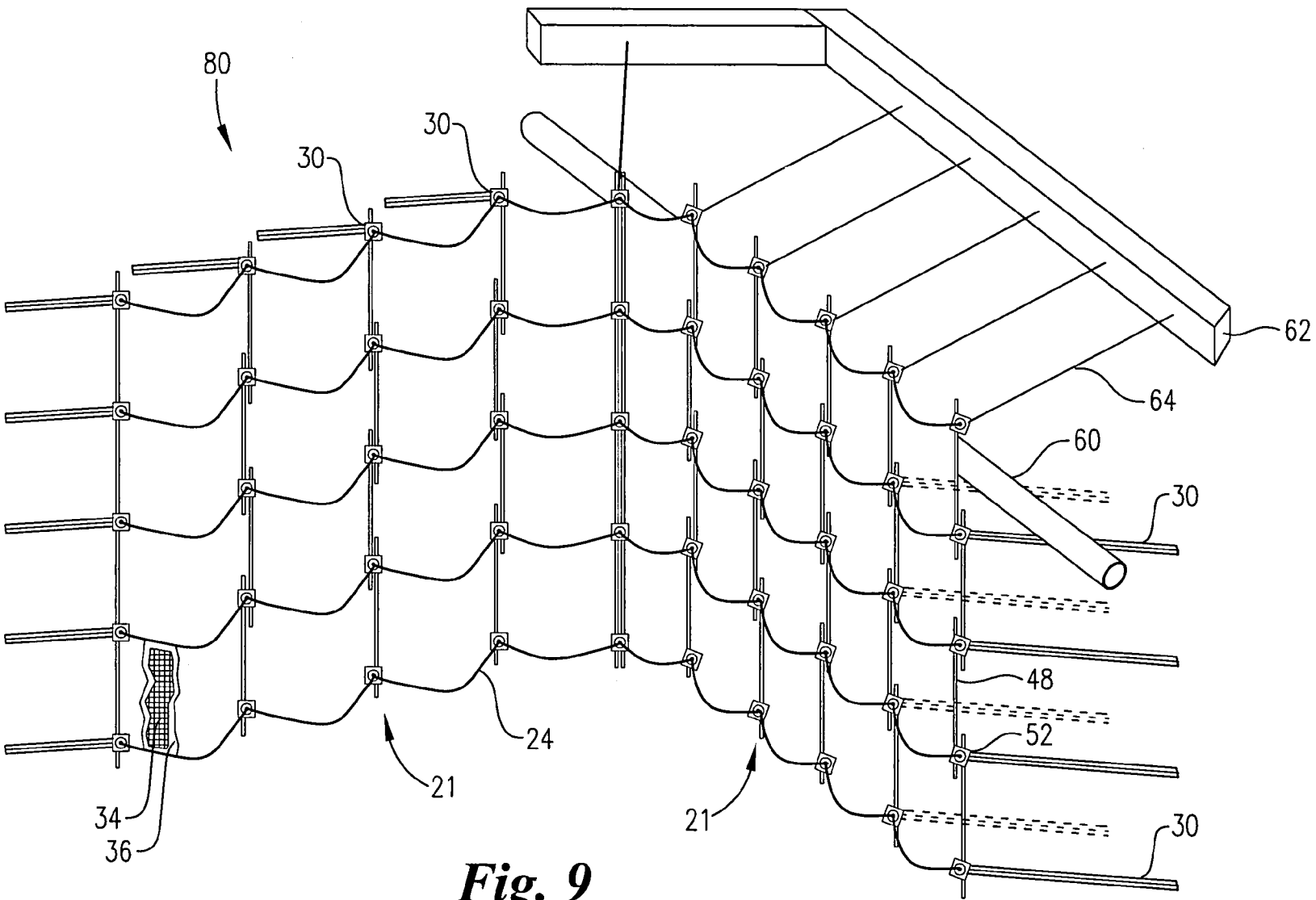
FIG. 9 is an isometric view of another soil nail wall in accordance with the present invention.
Figure 10:
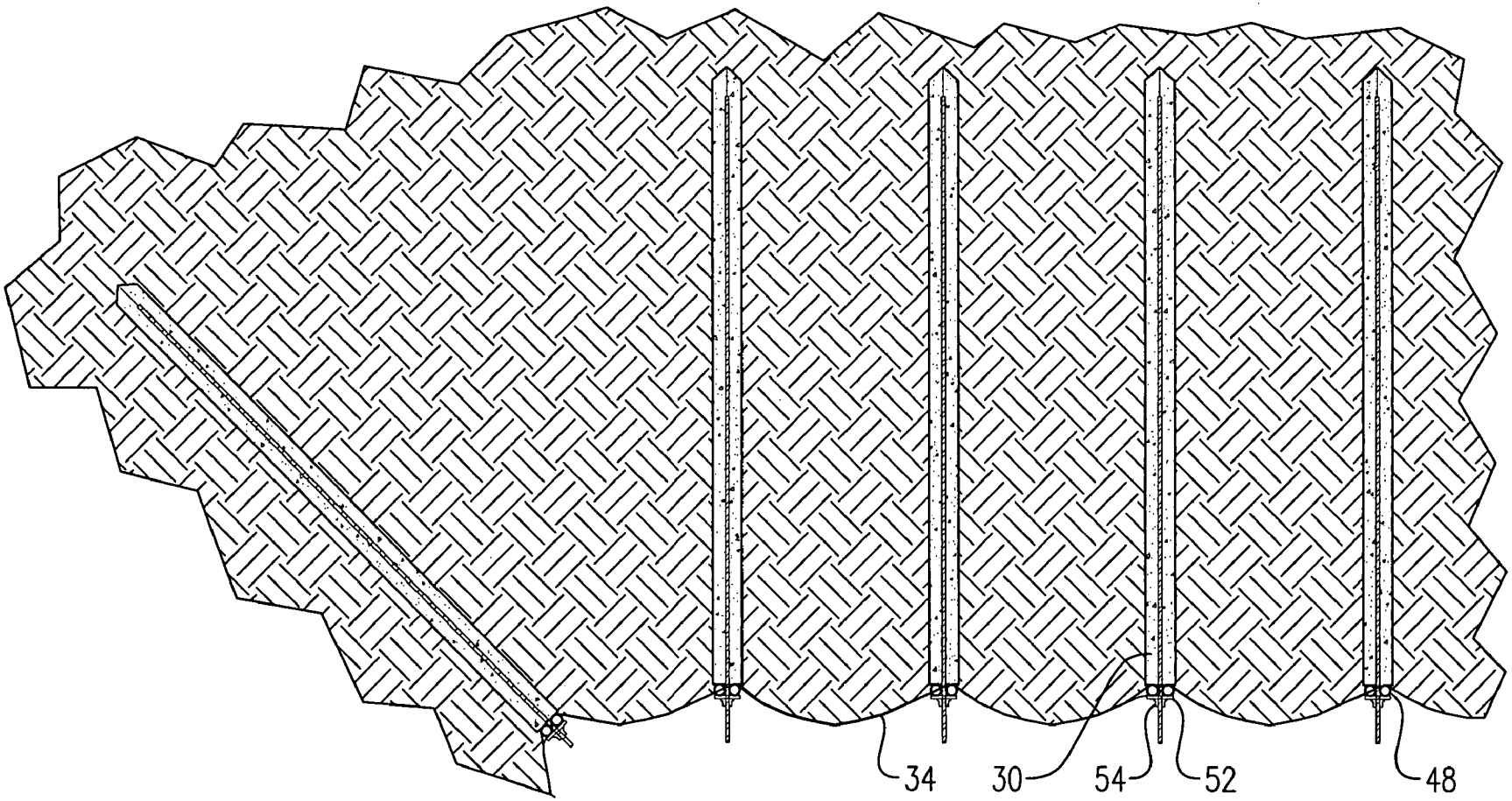
FIG. 10 is a horizontal cross-sectional view of the soil nail wall of FIG. 9.
Figure 11:
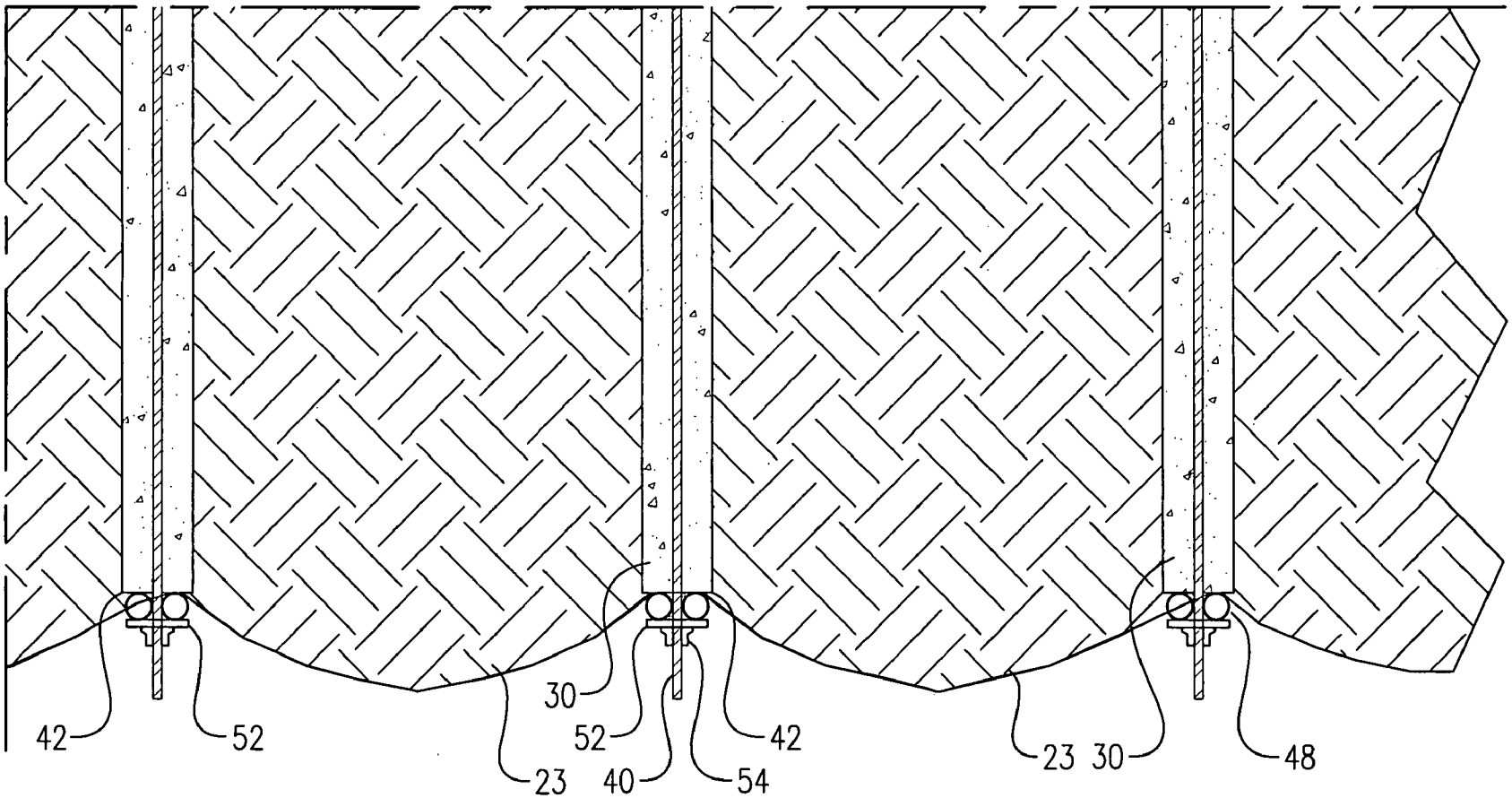
FIG. 11 is a detailed view of the soil nail wall of FIG. 10.
Figure 12:
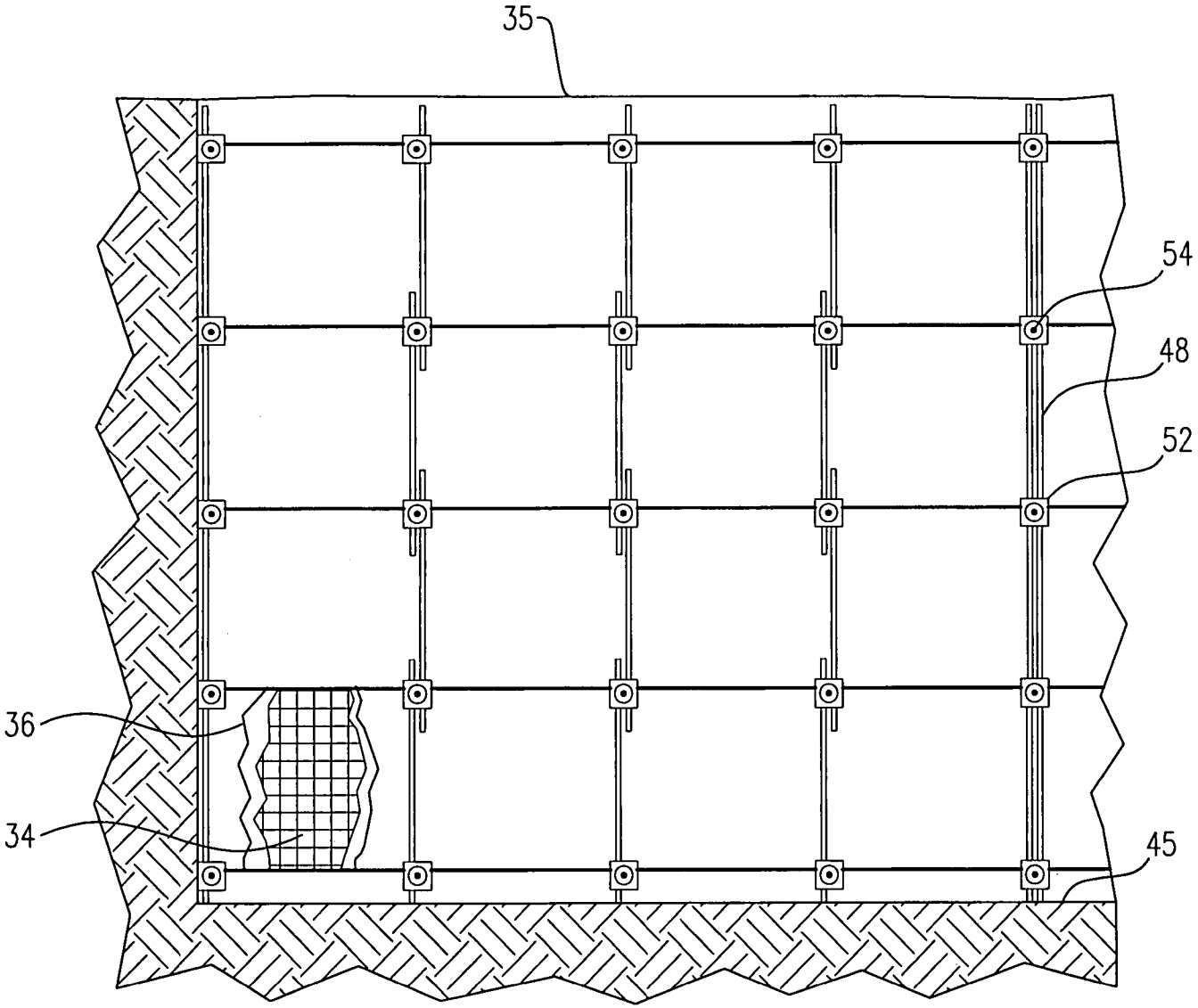
FIG. 12 is an elevation view of the soil nail wall of FIG. 9.

Wall system 20 previously described herein, is particularly suited for less stable soil formations exhibiting relatively short stand-up times. For more stable soil formations having longer stand-up times, it may not be necessary to construct a retaining wall system with all of the features described above. As shown in FIG. 9, it is possible to construct a wall system 80 without using soldier piles 22 and/or wales formed from wire rope 32. Elimination of one or both of these features may reduce the overall cost of construction.

Wall systems 80 are suitable for both temporary and permanent installation. Wall systems 80 are particularly useful with ground having a stand-up time greater than about 1-2 hours. Temporary systems generally are not equipped with fascia walls and need not include wire rope wales. However, wire rope wales may be used in permanent applications requiring fascia walls. Permanent wall systems preferably are equipped with permanent fascia walls as the geogrid material may exhibit a sensitivity to light and could weaken over time if not covered with a permanent facing. While not absolutely necessary in every application from a structural integrity standpoint, wire rope wales are preferably used with permanent systems in order to facilitate attachment of a fascia wall.

Wall systems 80 may be constructed very similarly to wall systems 20 described above. The most notable exceptions, however, are the elimination of soldier piles 22 and wire rope 32. Wall system 80 as shown in FIGS. 9-12 does not include wire rope wales or soldier piles. A vertical excavation, approximately 1-2 feet deep, is made along the desired location for forming upright face 24. A plurality of spaced-apart recessed areas 21 are then excavated in face 24. Conventional soil nails 30 are installed at the bottom of recessed areas 21 at a depth of between about 1-2 feet below the ground surface. After the grout in the soil nails has cured, the excavation is extended to a depth of about 3-6 feet below the upper row of soil nails 30 at an angle of about 15° from the vertical. A second row of soil nails is installed near the base of the excavation directly below soil nails 30 in the upper row so that the soil nail heads 42 are in vertical alignment. Nail heads 42 of the second row are positioned about at least one foot below the surface of the 15° incline.

After the soil nail grout has cured, additional soil is excavated so as to extend recessed areas 21 downward to the level of the second row of soil nails. A strip of geotextile fabric 36 is installed against upright face 24 and secured to the first row of soil nails 30. Strips of web material 34 are cut and the ends thereof are fastened to structural members 48 as shown in FIG. 5 and described above. Members 48 are placed on the outboard sides of spaced-apart soil nails 30 thereby drawing web 34 taut. Additional structural members 48 are positioned in the intermediate recessed portions 21 on the outside of web 34 as described above. Members 48 are secured using plates 52 and nuts 54 mounted on threadbars 40. Structural members 48 overlap the next vertically-adjacent member except at single or double anchor soil nails or at the ends of the strips of web material 34. Thus, the strips of web 34 create zones of compressed soil behind upright face 24 which add strength to the upright face.

The next section of face 24 is ready for excavation. The excavation is extended about 3-6 feet below the second row of soil nails at an angle of about 15° from the vertical, and the process is repeated until the final excavation depth is reached.

Figure 14:
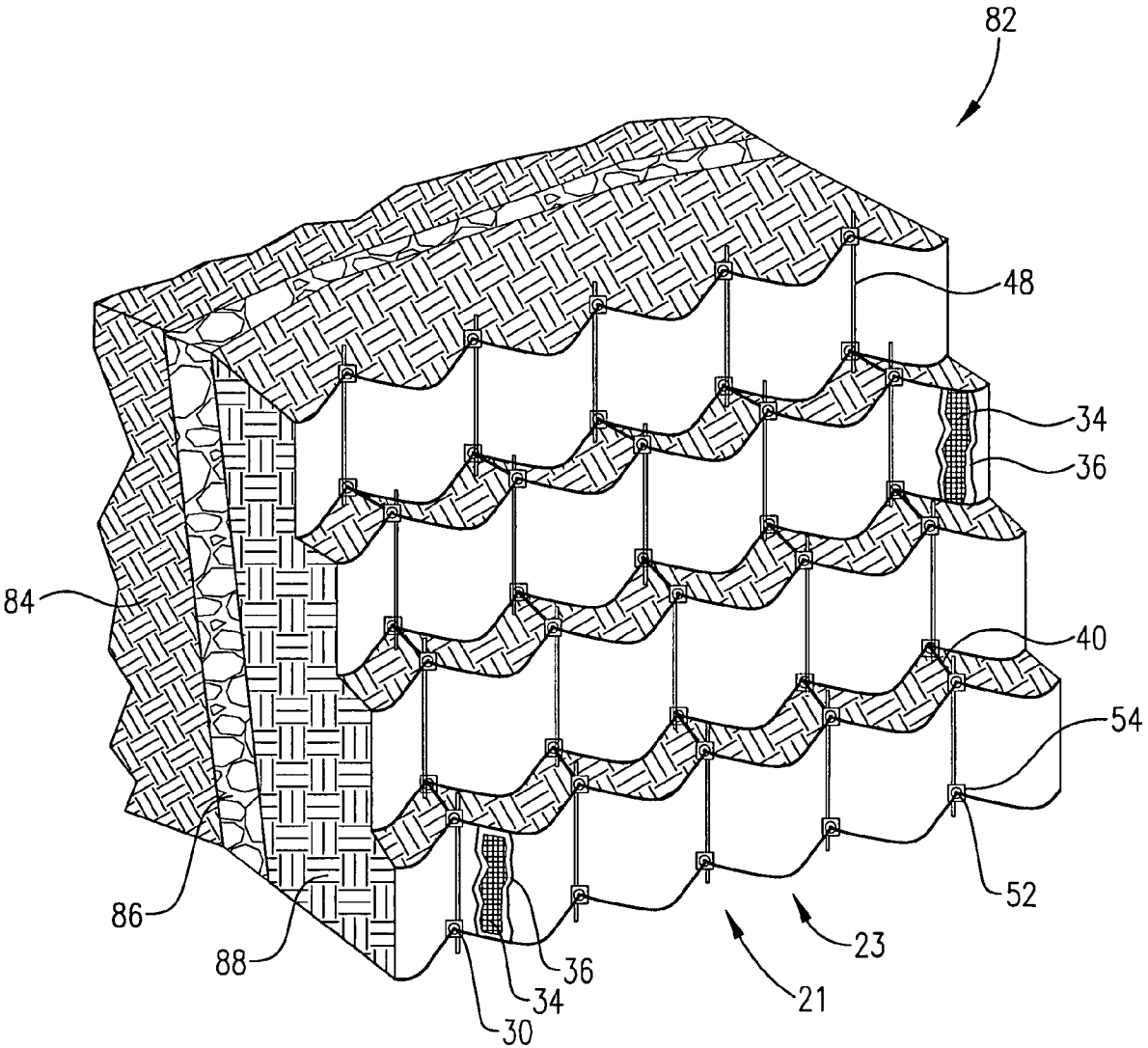
FIG. 14 is an isometric view of a tiered wall constructed in accordance with the present invention.
Figure 15:
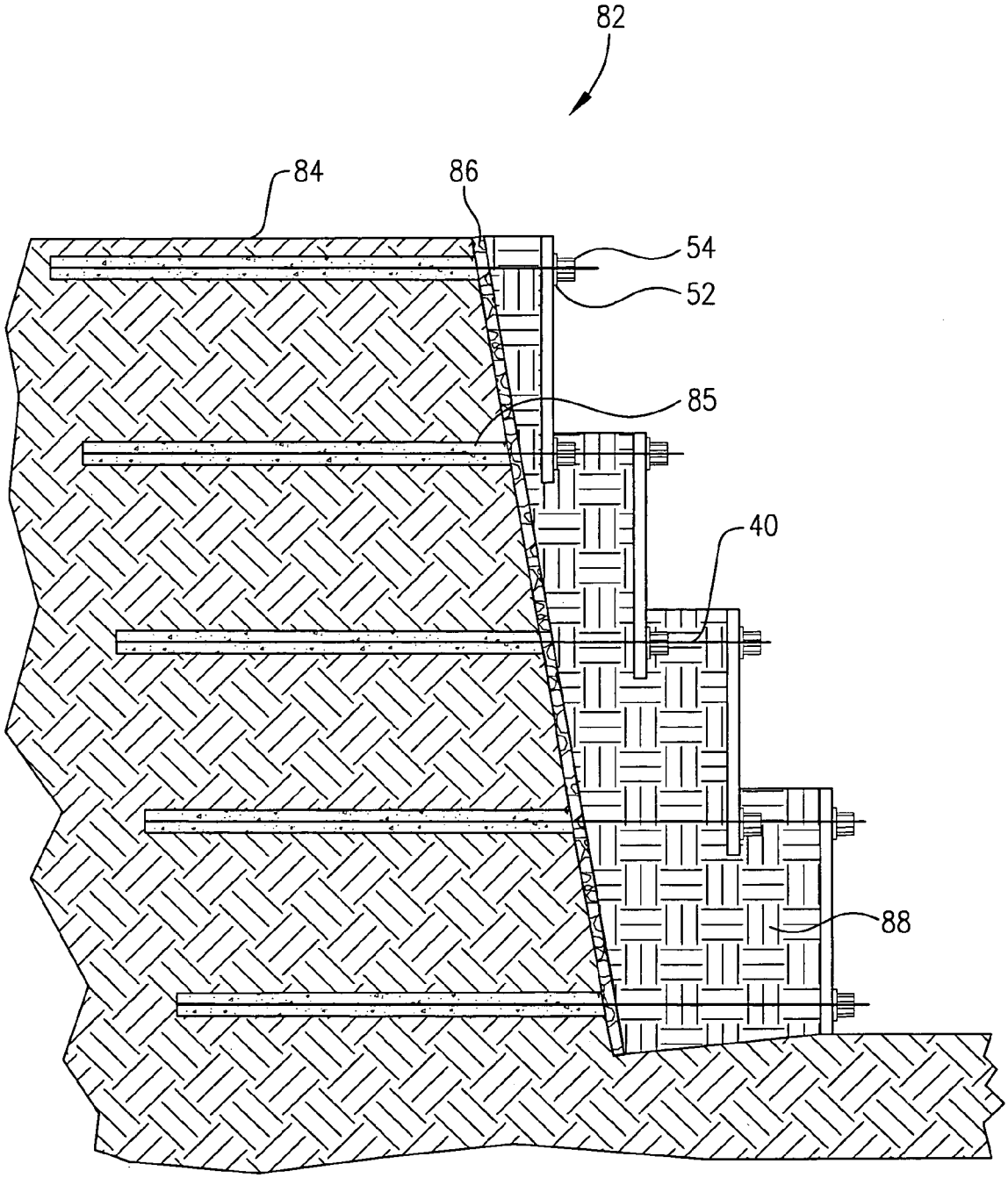
FIG. 15 is a vertical cross-sectional view of the tiered wall of FIG. 14.

Yet another embodiment of the present invention is depicted in FIGS. 14 and 15. In this embodiment, a tiered wall 82 is constructed using many of the same components and methodologies as the previously-described soil nail wall embodiments. Tiered wall 82 maybe constructed adjacent to existing nearly-vertical slopes 84 that tend to become unstable after periods of heavy rainfall. In the case of existing vertical slope 84, soil anchors 85 are installed at regular horizontal and vertical intervals from working platforms suspended from cranes or falseworks. Soil anchors 85 may comprise soil nails as used with the previous wall embodiments described above, or tieback anchors. Anchors 85 include threadbars 40 which extend far into slope 84 and protrude a substantial distance from the face thereof. Two pairs of nuts 54 and plates 52 are attached to each threadbar except for those belonging to the bottommost and uppermost rows of soil anchors. Strips of web material 34 are secured to two structural members 48. These two structural members 48 are attached to the bottom two rows of soil anchors. Additional structural members are placed in the intermediate recessed portions against the web 34. Structural members 48 are secured to threadbars 40 of the bottom two rows of soil anchors 85 using plates 52 and nuts 54. Strips of geotextile material 36 are then attached to the inboard side of web material 34. A one-foot wide by eight-inch thick section of drainage fill 86 is placed adjacent to slope 84. Soil 88 is then placed between drainage fill 86 and geotextile fabric 36 until the lower tier is completely back filled and web 34 is placed under tension.

The next row of structural members 48 and geosynthetic materials 34, 36 are then placed and soil is placed between the slope and the geosynthetic materials. This sequence is repeated until the entire slope 84 is covered. The tier setback widths are sufficient to allow planting of vegetation that may cover the width of the strip of web 34. When equipped with an irrigation system, the completed tier wall system 80 functions much like the celebrated Hanging Gardens of Babylon, which were in essence overhanging, irrigated gardens.

The embodiment of the tiered wall system 82 shown in FIGS. 14 and 15 illustrate the simplest wall design in accordance with the present invention in that soldier piles 22 and wire rope wales 32 are not employed. However, it is within the scope of the present invention for such features to be added to the tiered wall system 82 through the use of single or double-anchor soil nails 26, 28 and soldier piles 22 installed in the face of the existing slope. In any event, each tier of wall 82 retains the familiar style of alternating recessed areas 21 and protruding portions 23 which create zones of compressed soil behind the strips of web 34.

The wall systems described herein are preferably constructed without the use of any steel or wire mesh or shotcrete which are staple components of conventional soil nail walls.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A system for maintaining the integrity of an upright face of earth, said system comprising:

a plurality of spaced-apart soil nails extending into the earth, said upright face presenting an undulating, three-dimensional profile comprising a plurality of alternating vertically-extending recesses and protrusions, said recesses and protrusions extending continuously from the top to the bottom of the upright face, said soil nails being inserted within said recesses; and a tensioned web of pliable material held against the upright face by said soil nails, said web actively creating at least one zone of compressed soil behind the upright face.

2. The system according to claim 1; and a plurality of spaced-apart piles extending vertically into the earth.

3. The system according to claim 2, the upright face presenting a plurality of vertically-extending recessed portions formed between adjacent piles.

4. The system according to claim 1; and a reinforcing cable stretched across the upright face and coupled to said soil nails.

5. The system according to claim 4, said reinforcing cable comprising first and second cable sections, said first cable section being in secured to one of said soil nails and said second cable section being secured to one other of said soil nails.

6. The system according to claim 4; and a fascia wall secured to said reinforcing cable.

7. The system according to claim 1, said web comprising a synthetic resin mesh material.

8. The system according to claim 1 and a geotextile material secured to said soil nails and positioned between the upright face and said web.

9. The system accorrding to claim 1, said soil nails being arranged in a plurality of vertically-spaced rows, said tensioned web extending between adjacent vertically-spaced rows of soil nails.

10. A system for maintaining the integrity of an upright face of earth, said system comprising:

a plurality of spaced-apart piles extending vertically into the earth, the upright face presenting a plurality of vertically-extending recessed portions formed between adjacent piles, said recessed portions extending continuously from the top to the bottom of the upright face;

a plurality of spaced-apart soil nails inserted into the upright face within the recessed portions;

at least one reinforcing cable stretched across the upright face and coupled to said soil nails; and a web of pliable material held against the upright face.

11. The system according to claim 10, said soil nails arranged into at least first, second, and third vertically-spaced rows, a first strip of said web being secured to said first and second rows of soil nails; and a second strip of said web being secured to said second and third rows of soil nails.

12. The system according to claim 11, said system comprising at least one reinforcing cable secured to each of said vertically-spaced rows of soil nails.

13. The system according to claim 10; and a geotextile material secured to said soil nails and positioned between the upright face and said web.

14. The system according to claim 10, said web comprising a synthetic resin mesh material.

15. The system according to claim 10, said web and said at least one reinforcing cable creating a plurality of zones of compressed earth behind the upright face.

16. A tiered wall system comprising:

a first tier comprising— first and second vertically-spaced rows of soil anchors;

a first web of pliable material extending between said first and second rows of soil anchors and held in tension against a first upright face of earth, said first upright face presenting an undulating, three-dimensional profile comprising a first plurality of alternatinig vertically-extending recesses and protrusions, said recesses and protrusions extending continuously from the top to the bottom of the first upright face; and a second tier comprising said second row of soil anchors and a third row of soil anchors vertically spaced from said second row;

a second web of pliable material extending between said second and third rows of soil anchors and held in tension against a second upright face of earth offset from the first upright face of earth;

said second upright face presenting an undulating, three-dimensional profile comprising a second plurality of alternating vertically-extending recesses and protrusions;

said recesses and protrusions extending continuously from the top to the bottom of the second upright face.

17. The system according to claim 16, said system comprising a plurality of offset tiers.

18. The system according to claim 16, each of said tiers comprising a geotextile material secured to said rows of soil anchors and positioned between the portion of earth and said web.

19. The system according to claim 16, said web comprising a synthetic resin mesh material.

20. The system according to claim 16, said soil anchors being selected from the group consisting of soil nails and tieback anchors.

21. The system according to claim 16, said first and second pluralities of alternating vertically-extending recesses and protrusions being generally vertically aligned with one another.

22. A method of maintaining the integrity of an upright face of earth, said method comprising the steps of:

(a) excavating a first section of the upright face thereby forming a plurality of vertically-extending recessed portions that extend continuously from the top to the bottom of the first section of the upright face;

(b) installing a first set of spaced-apart soil nails into said recessed portions;

(c) extending a first web of pliable material across said first section of the upright face; and (d) coupling said web to said first set of soil nails thereby holding said web in tension against the first section of the upright face.

23. The method according to claim 22, said method including installing a plurality of vertical, spaced-apart piles into the earth prior to step (a).

24. The method according to claim 23, said vertically-extending recessed portions being formed in between adjacent piles.

25. The method according to claim 23; and (e) anchoring a first section of reinforcing cable in one soil nail of said first set, and anchoring a second section of reinforcing cable in another soil nail of said first set.

26. The method according to claim 25; and (f) joining said first and second cable sections so as bear against at least one of said piles.

27. The method according to claim 22; and (g) excavating a second section of the upright face;

(h) installing a second set of spaced-apart soil nails in said second section of the upright face;

(I) further excavating said second section of the upright face to downwardly extend said recessed portions from said first section, said second set of soil nails residing in the extended recessed portions;

(j) extending a second web of pliable material across said second section of the upright face; and (k) coupling said second web to said second set of soil nails thereby holding said second web in tension against the second section of the upright face.

28. The method according to claim 27; and (1) repeating steps (g)-(k) a plurality of times.

29. The method according to claim 28; and (m) installing a fascia wall in front of said upright face.

* * * * *